US005485133A

United States Patent [19]

Ward

[11] Patent Number: 5,485,133

[45] Date of Patent: Jan. 16, 1996

[54] CIRCUIT BREAKER

[75] Inventor: Patrick Ward, Ballinasloe, Ireland

[73] Assignee: Tripco Limited, County Galway, Ireland

[21] Appl. No.: 261,773

[22] Filed: Jun. 20, 1994

[51] Int. Cl.[6] ..... H01H 51/22

[52] U.S. Cl. ..... 335/78; 335/80; 335/128

[58] Field of Search ..... 335/78–86, 124, 335/128, 137

[56] References Cited

U.S. PATENT DOCUMENTS 3,950,718 3/1976 Nagamoto .

FOREIGN PATENT DOCUMENTS 387037 9/1931 United Kingdom .
864914 10/1958 United Kingdom .
1132521 1/1966 United Kingdom .
1147494 5/1967 United Kingdom .
1285633 11/1969 United Kingdom .
1524458 8/1976 United Kingdom .
2198885 6/1988 United Kingdom .

*Primary Examiner*—Lincoln Donovan
*Attorney, Agent, or Firm*—William C. Geary, III; Lahive & Cockfield

[57] ABSTRACT

A circuit breaker has at least one pair of electrical contacts of which one contact is mounted for movement relative to the other contact between first and second positions. One of the first and second positions corresponds to the contacts being closed and the other corresponds to the contacts being open. Resilient biassing means urges the one contact into the first position so as to maintain the contacts normally in the condition corresponding thereto. A magnet (such as a solenoid acting in active or passive mode) is capable of holding one contact in the second position against the action of the resilient biassing means, but is demagnetisable to permit the one contact to return to the first position.

3 Claims, 5 Drawing Sheets

CIRCUIT BREAKER

The present invention relates to a circuit breaker.

SUMMARY OF THE INVENTION

According to the present invention there is provided a circuit breaker comprising at least one pair of electrical contacts of which one contact is mounted for movement relative to the other contact between first and second positions wherein one of the said first and second positions corresponds to the contacts being closed and the other of the said first and second positions corresponds to the contacts being open, resilient biassing means urging the said one contact into the first position so as to maintain the contacts normally in the condition corresponding thereto, and magnet means for holding the said one contact in the second position against the action of the resilient biassing means, the magnet means being demagnetisable to permit the said one contact to return to the first position.

BRIEF DESCRIPTION OF THE INVENTION

Embodiments of the invention will now be described, by way of example, with reference to the accompanying drawings, in which:

FIGS. 1(*a*) to 1(*c*) are cross-sectional views of a circuit breaker according to a first embodiment of the invention at various stages of closure;

FIGS. 2(*a*) to 2(*c*) are similar cross-sectional views of a circuit breaker according to a second embodiment of the invention;

FIGS. 3(*a*) to 3(*c*) are similar cross-sectional views of a circuit breaker according to a third embodiment of the invention;

FIGS. 4(*a*) to 4(*c*) are similar cross-sectional views of a circuit breaker according to a fourth embodiment of the invention;

FIG. 5 is a cross-sectional view of a fifth embodiment of the invention; and FIG. 6 is a cross-sectional view of a sixth embodiment of the invention.

In the drawings similar numerals have been used to indicate like parts.

DETAILED DESCRIPTION OF THE INVENTION

Figure 1A:
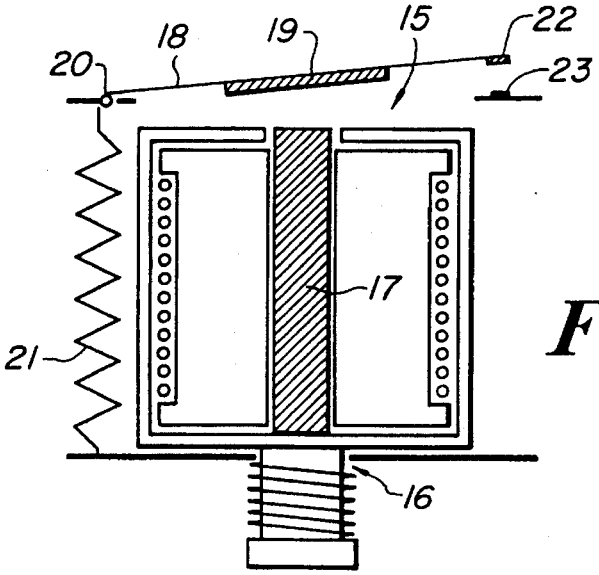
Figure 1B:
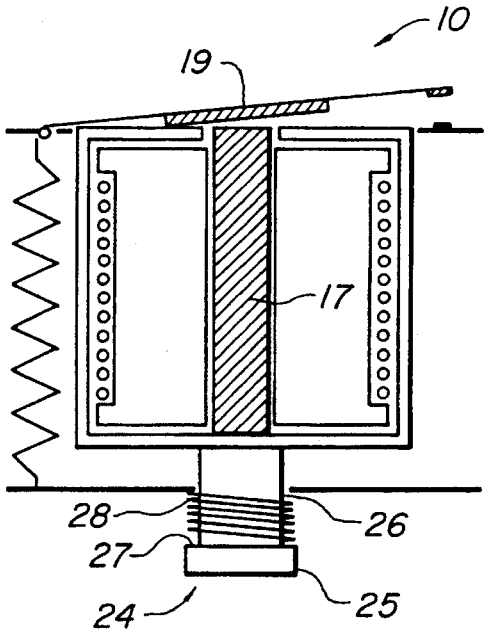
Figure 1C:
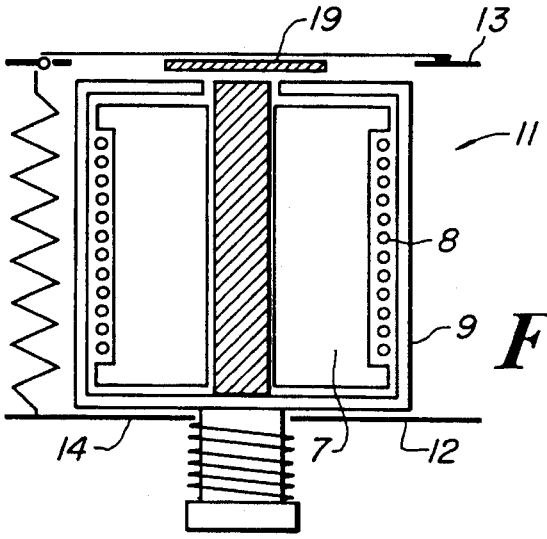

In FIG. 1 the circuit breaker 10 comprises a substantially cylindrical solenoid 11 having a bobbin shaped core 7 surrounded by an electrically conductive coil 8 through which current can be passed from a separate electrical circuit (not shown). The solenoid 11 is enclosed in a frame or yoke 9 of ferromagnetic material which in turn is enclosed in a housing 12 of which only the front and rear walls 13 and 14 respectively are shown. The magnetic frame 9 increases the efficiency of the solenoid 11 by reducing the amount of magnetic flux dissipated into the air surrounding the solenoid 11.

The solenoid 11 is located between two opposing holes 15 and 16 which are formed in the walls 13 and 14 respectively. The core 7 of the solenoid 11 has a cylindrical bore along its axis which accommodates a pole piece 17 of ferromagnetic material. The pole piece 17 protrudes slightly from the end of the core 7 adjacent the front wall 13, with the end of the pole piece 17 lying flush with the outside surface of the frame 9.

A contact arm 18 traverses the hole 15 in the front wall 13. A plate 19 of ferromagnetic material is fixed to the arm 18 in the region of the hole 15. The arm 18 is hinged at one end 20, and is biased by a coil spring 21 in a counterclockwise direction as seen in FIG. 1 so that the free end 22 of the arm 18 tends to pivot away from the front wall 13. When pushed against the bias of the spring 21 the end 22 of the arm 18 contacts the front wall 13 at a point 23. The end of the arm 22 and the point 23 therefore form the contacts of an electrical switch which, due to the action of the bias spring 21, is normally open.

A push button 24 passes through the hole 16 in the rear wall 14 and is secured to the rear of the frame 9. The button 24 has an enlarged head 25 which together with its body 26 defines a shoulder 27. A coil spring 28 is located around the body 26 of the button 24, and is held in compression between the shoulder 27 and the rear wall 14. The spring 28 urges the button 24 away from the rear wall 14 so that the frame 9 normally abuts the rear wall 14, FIG. 1(*a*). However, by pushing the button 24, the solenoid 11 can be moved bodily forward on its own axis into the hole 15, as seen in FIG. 1(*b*).

The circuit breaker 10 can operate in either of two modes, active or passive, as desired by the user.

In the active mode, a current flows continuously in the solenoid coil 8. This current, known as a magnetising current, generates a magnetic flux through and around the solenoid, primarily in the frame 9 and pole piece 17. The magnetic flux does extend beyond the front of the frame 9 and pole piece 17 towards the plate 19 on the moving contact arm 18, but for a given level of current, referred to as the holding current, the magnetic force generated by the solenoid will not be strong enough to pull the contact arm 18 from its spring biased open position as shown in FIG. 1(*a*) to the closed position as shown in FIG. 1(*c*).

However, to set the contact breaker the solenoid 11 is moved manually from the position of FIG. 1(*a*) to the position of FIG. 1(*b*) by pushing the button 24. This substantially reduces the air gap between the solenoid 11 and the moving contact arm 18, so that the plate 19 on the contact arm 18 becomes strongly magnetically coupled to the solenoid frame 9 and pole piece 17. In this position the magnetic force resulting from the holding current is greater than the force exerted by the bias spring 21, and therefore when the solenoid 11 is allowed to return to its initial position by removal of the manual force on the button 24, the contact arm 18 is magnetically entrained and drawn from the open position of FIG. 1(*a*) to the closed position of FIG. 1(*c*).

In this position, the air gap between the plate 19 and the solenoid frame 9 and pole piece 17 is substantially eliminated resulting in a magnetic circuit being completed around the solenoid with a resultant maximisation of the holding force between the moving contact arm 18 and the solenoid frame 9 and pole piece 17, thereby closing and maintaining closed the contacts 22 and 23 so long as the holding current flows in the solenoid coil 8.

When the holding current is interrupted or substantially reduced such that the holding force between the plate 19 and the solenoid frame 9 and pole piece 17 is less than the force of the bias spring 21 tending to open the contacts 22 and 23, the moving contact arm 18 will pivot to the open position shown in FIG. 1(*a*).

In the passive mode, no current flows through the solenoid coil 8 under normal conditions. The magnetic holding force is provided by a permanent magnet which can be located anywhere within the magnetic circuit of the solenoid frame 9, the pole piece 17 and the ferromagnetic plate 19. In the present case it is assumed that the pole piece 17 is the permanent magnet, but it could alternatively or additionally be the frame 9 or plate 19. When the device is in the state shown in FIG. 1(*a*) the magnetic force on the plate 19 due to the permanent magnet is not sufficiently strong to overcome the force of the bias spring 21 so that the moving contact arm 18 remains in the open position.

The contact breaker is manually set in the same manner as already described above. The button 24 is pushed to bring the forward end of the solenoid 11 into contact with the plate 19 (FIG. 1(*b*)) so that the arm 18 becomes magnetically entrained by the pole piece 17 and the frame 9 upon return of the solenoid to the initial position, the switch contacts 22 and 23 then being maintained in the closed position by the holding force of the permanent magnet which is greater than the force of the bias spring 21 tending to open the switch.

To open the switch contacts 22 and 23 a current is caused to flow in the solenoid coil 8 in such a direction as to generate a magnetic flux which opposes the magnetisation of the permanent magnet and reduces the holding force exerted thereby on the plate 19, the amplitude of such current being sufficiently large that the magnetic holding force is reduced below the force of the bias spring 21 which thereby causes the moving contact arm 18 to return to the open position shown in FIG. 1(*a*). This current is only required to flow for a period of time sufficient to effect the opening operation.

The passive mode is very economical in that it does not consume power in either of its two states, open or closed, and only consumes power during the opening operation.

In the active mode, the absence of the holding current will prevent closure of the circuit breaker to the position of FIG. 1(*c*). Also, removal of the holding current will result in automatic opening of the contacts 22 and 23 if the circuit breaker is in the closed position of FIG. 1(*c*). In normal operation, this current will be intentionally interrupted to achieve the opening function. However, in some instances, the holding current could be removed unintentionally, for example at times of power failure, etc. Under such conditions, the circuit breaker will revert to the open position of FIG. 1(*a*). The inability to close the circuit breaker due to the absence of supply current or automatic opening due to the loss of supply current can be a desirable feature in some applications, such as in some RCD products. This type of operation is often referred to as a fail safe operation, whereby the circuit breaker prevents connection of power to or removes power from the circuit connected to contacts 22 and 23 under conditions of absence or loss of mains supply, thereby maintaining the circuit connected between contacts 22 and 23 in a safe mode during failures of the supply.

In either mode it will be seen that the resilience of the bias spring 21 need only be capable of moving the contact arm 18 away from the front wall 13. Because of the relatively low mass of the contact arm 18, this resilience is minimal. As such only minimal current need be circulated through the coil 8 to maintain the coupling of the pole piece 17 and the contact arm 18 against this resilient force. Thus, less operational power is consumed, in particular in fail safe (active) mode, where current is continuously circulated through the coil 8.

Figure 2A:
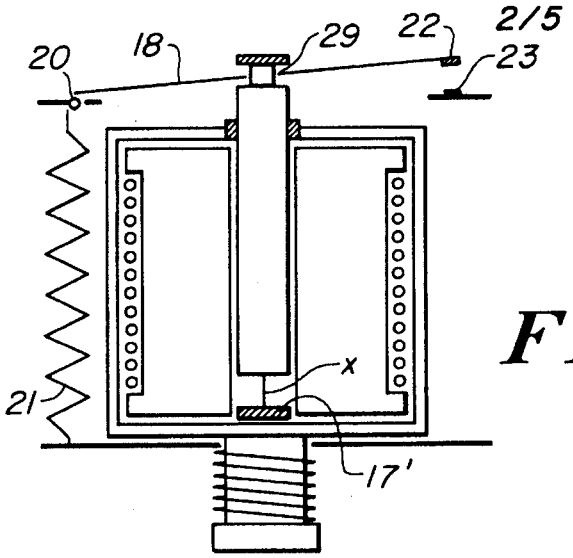
Figure 2B:
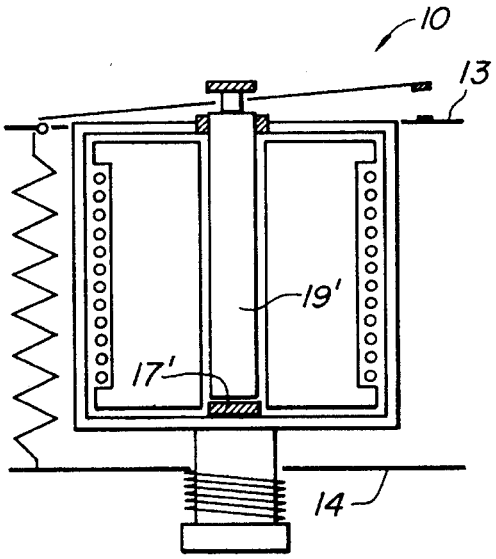
Figure 2C:
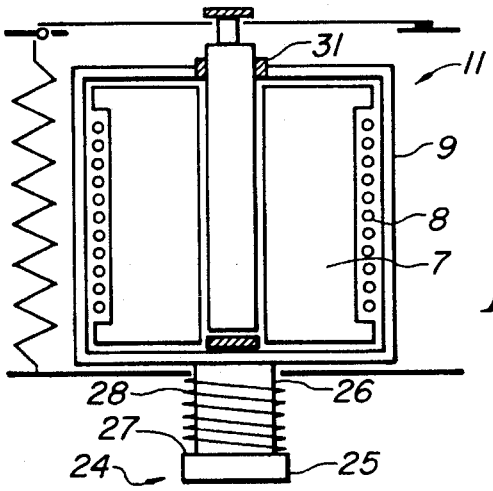

Turning now to FIG. 2, in the second embodiment the pole piece 17 has been replaced by a much shorter pole piece 17' which occupies only the rear end of the bore in the hollow core 7, and the plate 19 has been replaced by a ferromagnetic plunger 19' having a narrowed neck 29 by which the forward end of the plunger 19' is loosely connected to the contact arm 18. The major part of the length of the plunger 19' is slidably accomodated in the bore at the center of the solenoid core 7, there being a gap 'x' between the rear end of the plunger 19' and the pole piece 17' when the contact arm 18 is in the open position, FIG. 2(*a*).

To set the circuit breaker, the button 24 is depressed, as before, so as to move the solenoid 11 bodily towards the front wall 13 relative to the plunger 19' until the rear end of the plunger 19' comes in contact with and is coupled magnetically with the pole piece 17', FIG. 2(*b*). The button 24 is then released so that the solenoid 11 returns to its initial position with the plunger 19' and contact arm 18 in train, so bringing the contacts 22 and 23 together, FIG. 2(*c*).

The plunger 19' is a separated from the front of the frame 9 by an electrically insulating annular sheath 31. This concentrates magnetic flux in the region of the pole piece 17' and ensures that the plunger 19' does not move away from the pole piece 17' unless the magnetic circuit is broken.

The circuit breaker 10 of FIG. 2 can also operate in active and passive modes. In the passive mode, the plunger 19' and/or the pole piece 17' and/or the frame 9 is permanently magnetised and a current does not normally flow in the coil 8, the strength of the magnetic holding force provided by the permanent magnet being greater than that of the bias of the spring 21 so that once set closed the contacts 22 and 23 are held closed solely by the magnetic holding force. When thus set closed, the contacts may be opened by passing a current through the coil 8 sufficient in magnitude and direction to reduce the magnetic holding force below that of the bias spring 21.

In the active mode a current normally flows in the coil 8 to provide the magnetic force required to entrain the plunger 19' and close and hold closed the contacts 22 and 23, and the opening of the contacts is effected by interrupting this current or reducing it to a level at which the force of the bias spring 21 prevails.

Figure 3A:
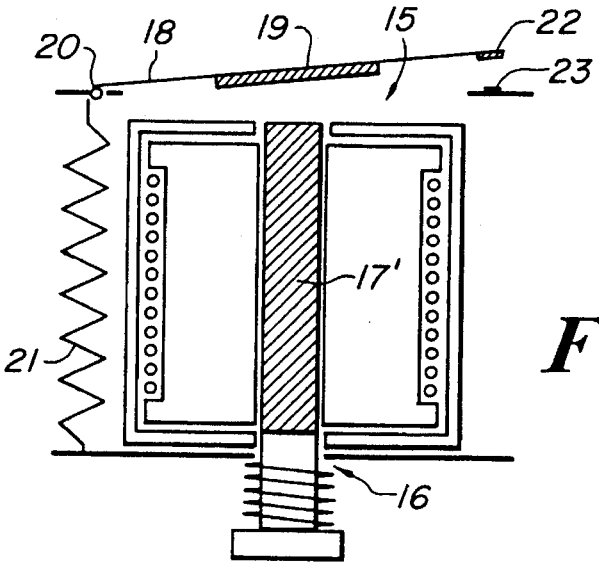
Figure 3B:
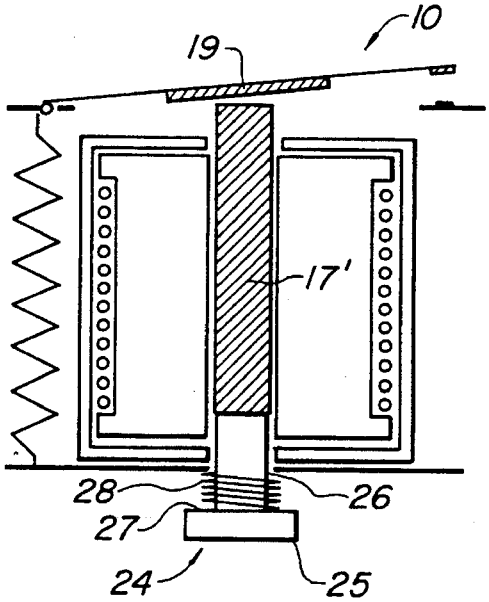
Figure 3C:
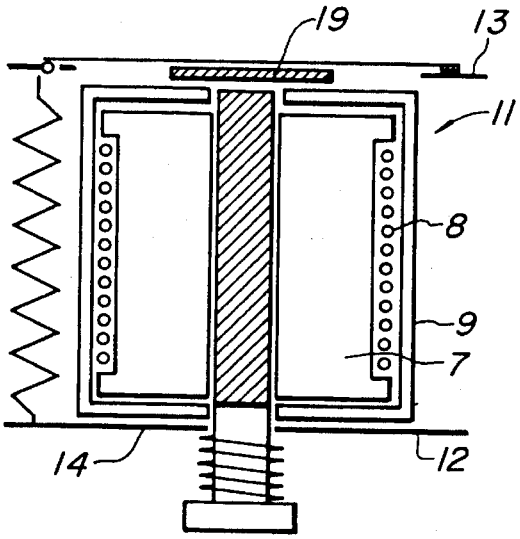

FIG. 3 shows a third embodiment of the invention which is modification of the first embodiment. In this case the solenoid 11 is fixed in position against the wall 14 and only the ferromagnetic pole piece 17 (now in the form of a plunger slidably accomodated in the bore of the solenoid core 7) moves towards and away from the plate 19 on the arm 18. Here the push button 24 and spring 28 are associated with the plunger 17, so that the plunger is normally fully retracted into the solenoid core by the spring 28 as shown in FIG. 3(*a*). However, by pressing on the push button 24 the plunger 17 can be forced out of the solenoid core against the bias of the spring 28 sufficiently to engage the plate 19, FIG. 3(*b*), so that upon release of the push button 24 and return of the plunger into the solenoid core under the bias of the spring 28 the contact 22 is drawn into engagement with the contact 23 and held there, FIG. 3(*c*), until released.

As before, such an embodiment could be operated in active mode where current normally passes through the coil 8 and the contact 22 is released by removing or reducing the coil current, or in passive mode where the plunger 17 and/or frame 9 and/or plate 19 is a permanent magnet and a current is only passed through the coil when the contact 22 is to be released.

Figure 4A:
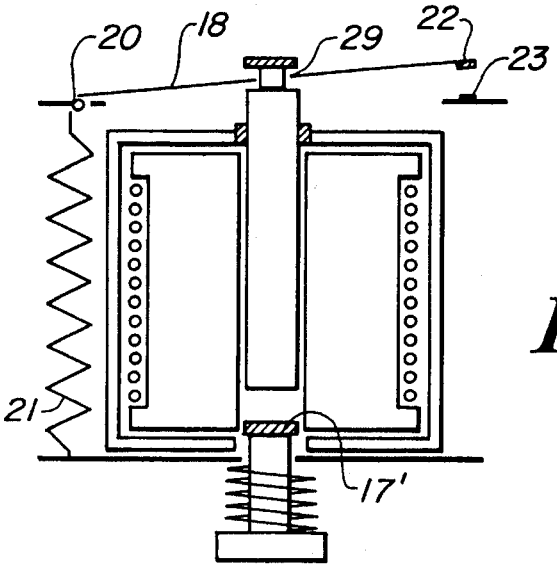
Figure 4B:
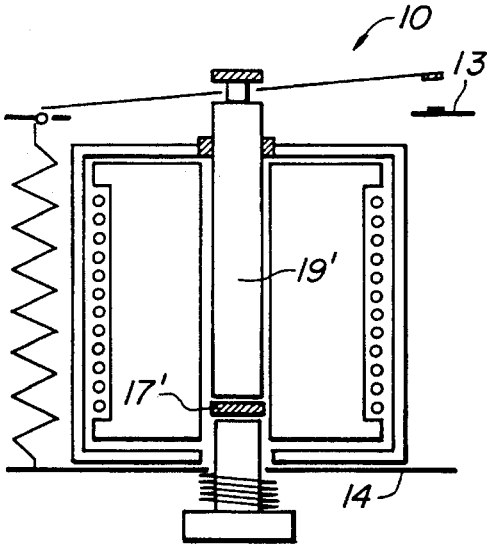
Figure 4C:
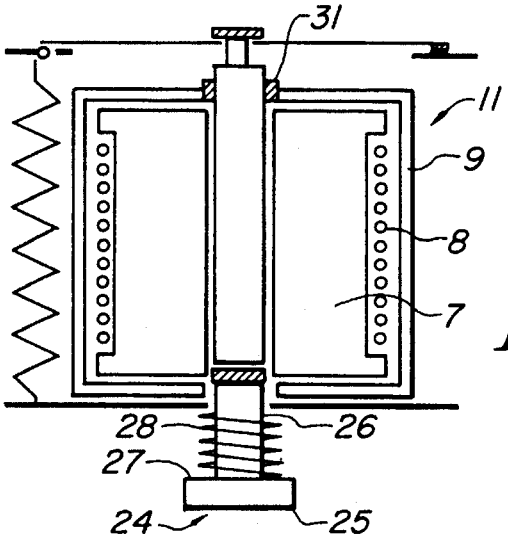

FIG. 4 shows a fourth embodiment of the invention which is modification of the second embodiment. In this case the solenoid 11 is also fixed in position against the wall 14 and it is only the ferromagnetic pole piece 17' which moves towards and away from the plunger 19'. The push button 24 and spring 28 are associated with the pole piece 17', so that the latter is normally fully retracted to the rear end of the solenoid by the spring 28 as shown in FIG. 4(*a*). However, by pressing on the push button 24 the pole pice 17' can be forced forwardly along the solenoid core against the bias of the spring 28 sufficiently to engage the plunger 19', FIG. 4(*b*), so that upon release of the push button 24 and return of the pole piece 17' to the rear of the solenoid core under the bias of the spring 28 the contact 22 is drawn into engagement with the contact 23 and held there, FIG. 4(*c*), until released.

Here again, this fourth embodiment could be operated in active mode where current normally passes through the coil 8 and is reduced or removed to release the contact 22, or in passive mode where the pole piece 17' and/or frame 9 and/or plunger 19' is a permanent magnet and current is passed through the coil only when the contact 22 is to be released.

Figure 5:
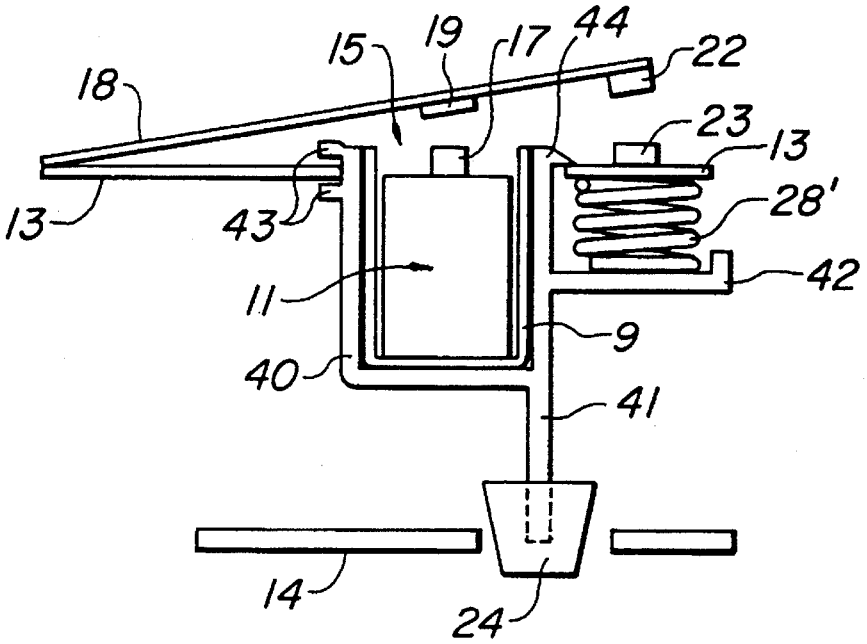

FIG. 5 shows a fifth embodiment of the invention which operates in a similar manner to the embodiment of FIG. 1 and the same reference numerals as FIG. 1 have been used for the same or equivalent components. In this embodiment the solenoid 11 is mounted in a cylindrical plastic housing 40 which is mounted on the front wall 13 and carries the push button 24 on an integral rearward extension 41. A coil spring 28' under compression between the wall 13 and a flange 42 integral with and projecting laterally from the housing 40 biasses the housing 40 into the rest position shown in FIG. 5. Also, in this embodiment the arm 18 carrying the contact 22 is resilient and is self-biassed away from the solenoid 11 and contact 23 into the open position shown in FIG. 5.

When the button 24 is pushed in, the bias of the coil spring 28' is overcome and the housing 40 rotates in a counter-clockwise direction about its left hand front edge (as seen in FIG. 5) due to the flanges 43 embracing the edge of the wall 13 at that point. The front end of the pole piece 17 is thereby pushed towards and into contact with the ferromagnetic plate 19. Now, when the push button 24 is released, the biassing spring 28' returns the housing 40 and solenoid 11 to the rest position shown in FIG. 5. A catch 44 on the right hand front edge of the housing 40 defines the rest position.

During the return of the housing 40 to the rest postion, the plate 19 is magnetically entrained by the pole piece 17 so that the contact 22 on the arm 18 is drawn, against the resilient bias of the arm 18, into engagement with the contact 23 on the wall 13. The contact 22 remains in engagement with the contact 23 as long as the magnetic attraction between the pole piece 17 and plate 19 is maintained, but as soon as the magnetic atraction is substantially reduced or removed the contacts 22 and 23 will separate because the resilience of the arm 18 will return the contact 22 to the position shown in FIG. 5.

As in the embodiment of FIG. 1, this fifth embodiment is operable in active or passive modes. Thus in the active mode a holding current flows continuously in the solenoid 11 to magnetise the normally unmagnetised pole piece 17, permitting the latter to entrain the plate 19 as described above and hold the contacts 22 and 23 together against the resilent bias of the arm 18 tending to open the contacts 22 and 23. Then, when the holding current is interrupted or substantially reduced, the contact arm 18 is released and its inherent resilience causes it to pivot to the open position shown in FIG. 5.

In the passive mode, the pole piece 17 or some other component in the magnetic circuit is permanently magnetised and no current normally flows in the solenoid. The permanent magnetism is sufficient to permit the pole piece 17 to entrain the plate 19 and hold the contacts 22 and 23 together against the resilent bias of the arm 18.

To open the switch contacts 22 and 23 a current is caused to flow in the solenoid 11 in such a direction as to generate a magnetic flux which opposes the permanent magnetism in the magnetic circuit and reduces the attractive force between the pole piece 17 and the plate 19 below the resilient biassing force of the contact arm 18 which thereby returns to the open position shown in FIG. 5. This current is only required to flow for a period of time sufficient to effect the opening operation.

Figure 6:
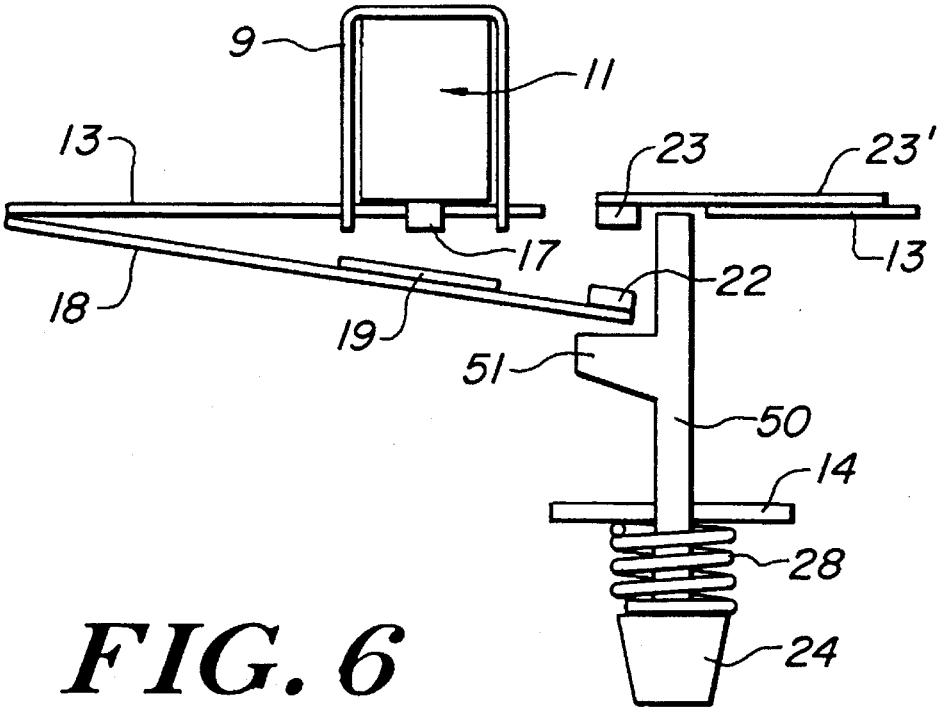

In the sixth embodiment, FIG. 6, the solenoid 11 is mounted on the front wall 13 on the opposite side thereof to the push button 24 and the contact arm 18 is mounted on the wall 13 on the same side as the push button 24. The solenoid 11 is fixed in position on the wall 13, and the arm 18 is self-biassing into the open position as described above for FIG. 5. Further, the contact 23 is not mounted directly on the wall 13, but is mounted on a second resilient arm 23' which is self-biassed to the rest position shown in FIG. 6, that is, lying along the surface of the wall 13. The push button 24 is mounted on a plastics rod 50 with a lateral extension 51.

When the button 24 is pushed in, the lateral extension 51 of the rod 50 pushes the ferromagnetic plate 19 into contact with the pole piece 17 and, simultaneously, the arm 23' is pushed forwardly away from the wall 13. When the button 24 is released, the magnetic attraction between the pole piece 17 and the plate 19 retains the arm 18 in contact with the solenoid 11 but the arm 23' returns to the FIG. 6 position so that the contact 23 engages the contact 22.

The contact 22 remains in engagement with the contact 23 as long as the magnetic attraction between the pole piece 17 and plate 19 is maintained, but as soon as the magnetic attraction is substantially reduced or removed the contacts 22 and 23 will separate because the resilience of the arm 18 will return the contact 22 to the position shown in FIG. 6.

This sixth embodiment may be operated in active and passive modes as described with reference to the preceding embodiments.

Variations of the foregoing embodiments are possible. For example, in the embodiment of FIG. 1 it is possible to effect the transition from the position of FIG. 1(*a*) to the position of FIG. 1(*c*) solely by electrical means, without movement of the solenoid 11 or pole piece 17. To this end, in the position of FIG. 1(*a*) a current substantially greater than the holding current is caused to flow in the solenoid coil 8. This higher current is of a magnitude sufficiently large to generate a magnetic flux between the plate 19 on the moving contact arm 18 and the solenoid frame 9 and pole piece 17 sufficient to provide a magnetic force which can pull the moving contact arm 18 onto the solenoid and pole piece as shown in FIG. 1(*c*). This higher current may be reduced to the level of the holding current when the contacts 22 and 23 are closed, thereby reducing power consumption or heat generation in the solenoid 11. When coil current is interrupted or substantially reduced such that the holding force between the plate 19 and frame 9 and pole piece 17 is less than the opening force of the bias spring 21, the moving contact arm 18 will pivot to the position as shown in FIG. 1(*a*).

It is also possible, instead of employing a separate spring 21 to bias the contact arm 18 away from the front wall 13, to make the contact arm 18 itself from a resilient material and mount it to the front wall 13 such that its free end 22 tends to flex away from the contact 23, as described for FIGS. 5 and 6.

Further, the devices described in the foregoing embodiments could be used to make/break more than one pair of contacts 22, 23 simultaneously, by having multiple sets of contact pairs 22, 23 ganged or otherwise directly or indirectly mechanically coupled together for simultaneous opening and closing by the solenoid.

It is also possible for there to be one or more pairs of normally closed contacts mechanically coupled to the normally open contact pair(s) 22, 23, such that the normally closed contacts are held open when the contact pair(s) 22, 23 are held closed but close when the contact pair(s) 22, 23 open. These normally closed contacts could be used to indicate that the device is in the open or tripped state.

Indeed, it is possible in each of the embodiments for the device to have normally closed contacts 22, 23 instead of the normally open contacts described in FIGS. 1 to 4. In this case, the bias of the spring 21 would tend to close the contacts 22 and 23 and in the set condition the contact 22 would be held away from the contact 23 by the magnetic holding force acting in opposition to the bias. Then, upon removal of the magnetic holding force, the contact 22 would close onto the contact 23 under the action of the bias spring 21.

The devices can be employed in a number of ways. The front wall 13 can be part of a conventional printed circuit board (PCB), with the contact arm 18 mounted thereon in a conventional manner and the housing 12 being fixed to opposite side of the PCB. Alternatively, the circuit breaker 10 can be a self contained unit having two external contact terminals and two power terminals.

One of the key requirements of residual current devices, which include circuit breakers, is that they are 'trip free' ie. the device must be able to trip despite manual action to prevent the device from tripping and opening the contacts. To ensure 'trip free' operation of the circuit breaker, manual access to the contact arm 18 can be prevented by enclosing the contact arm 18 within a suitable enclosure.

What is claimed is:

1. A circuit breaker comprising first and second electrical contacts of which the first contact is mounted for movement relative to the second contact between a first position in which the contacts are closed and a second position in which the contacts are open, first resilient biassing means urging the first contact into the second position so as to maintain the contacts normally open, magnet means for retaining the first contact in the first position against the action of the first resilient biassing means so as to hold the contacts closed, the magnet means being demagnetisable at least sufficiently to permit the first contact to return to the second position under the action of the first resilient biassing means, and manually operable reset means for resetting the first contact from the second position to the first position against the action of the first resilient biassing means, wherein the circuit breaker also includes second resilient biassing means urging the second contact towards a rest position for engagement by the first contact when the latter is in the first position, the reset means being operable as it resets the first contact from the second position to the first position to also push the second contact away from its rest position against the action of the second resilient biassing means whereby when the first contact reaches the first position the second contact is held out of engagement therewith by the reset means, and wherein upon release of the reset means the second contact is urged by the second resilient biassing means into engagement with the first contact.

2. A circuit breaker according to claim 1, wherein the magnet means includes a solenoid, a current being passed through the solenoid for retaining the first contact in the first position and the current being removed or substantially reduced to demagnetize the solenoid sufficiently to permit the first contact to return to the second position.

3. A circuit breaker according to claim 2, wherein the magnet means includes a permanent magnet for retaining the first contact in the first position, the circuit breaker further including a solenoid, a current being passed through the solenoid for demagnetizing the permanent magnet sufficiently to permit the first contact to return to the second position.

* * * * *